US005649556A

United States Patent [19]

Braun

[11] Patent Number: 5,649,556

[45] Date of Patent: Jul. 22, 1997

[54] CLEANING DEVICE FOR CLEANING THE SHAVING HEAD OF A DRY SHAVING APPARATUS

[75] Inventor: Gebhard Braun, Kelkheim, Germany

[73] Assignee: Braun Aktiengesellschaft, Kronberg, Germany

[21] Appl. No.: 370,681

[22] Filed: Jan. 10, 1995

[30] Foreign Application Priority Data

Jan. 26, 1994 [DE] Germany ..... 44 02 237.9

[51] Int. Cl.[6] ..... B08B 9/00

[52] U.S. Cl. ..... 134/92; 134/111; 134/186; 134/166 R

[58] Field of Search ..... 134/111, 155, 134/186, 92, 184, 166 C, 166 R, 201, 62, 116, 135

[56] References Cited

U.S. PATENT DOCUMENTS

| | | | |
|---|---|---|---|
| 1,105,045 | 7/1914 | Shipherd | 134/111 |
| 2,485,968 | 10/1949 | Hilliker | 134/111 |
| 2,595,838 | 5/1952 | Fuglie | 134/111 |
| 2,675,012 | 4/1954 | Scales | 134/111 |
| 3,096,776 | 7/1963 | DeWitt | 134/111 |
| 3,172,416 | 3/1965 | Simmons . | |
| 3,227,167 | 1/1966 | Parent | 134/109 |
| 3,365,267 | 1/1968 | Mekiney et al. | 134/111 |
| 3,378,019 | 4/1968 | Riolo et al. | 134/111 |
| 3,480,022 | 11/1969 | Richardson et al. | 134/135 |
| 3,876,649 | 4/1975 | Schimke | 134/95 |
| 3,890,988 | 6/1975 | Lee | 134/111 |
| 3,908,681 | 9/1975 | Schimke et al. | 134/95.2 |
| 4,054,963 | 10/1977 | Taylor . | |
| 4,105,342 | 8/1978 | Plourde | 134/111 |
| 4,442,956 | 4/1984 | Nasu | 30/41.5 |
| 4,462,415 | 7/1984 | Otzen | 134/111 |
| 4,549,352 | 10/1985 | Ochiai et al. | 30/41.5 |
| 4,597,126 | 7/1986 | Beech | 134/155 |
| 4,631,825 | 12/1986 | Kuriama et al. | 30/43.92 |
| 4,730,631 | 3/1988 | Schwartz | 134/155 |
| 4,815,486 | 3/1989 | Schinn | 134/155 |
| 4,991,609 | 2/1991 | Browning | 134/184 |
| 5,064,521 | 11/1991 | Stepanenko et al. | 204/224 M |
| 5,095,925 | 3/1992 | Elledge et al. | 134/184 |
| 5,118,357 | 6/1992 | Sabatka | 134/64 R |
| 5,143,101 | 9/1992 | Mor | 134/108 |
| 5,156,813 | 10/1992 | Calhoun | 134/186 |
| 5,179,890 | 1/1993 | Reuveni et al. | 134/64 R |
| 5,186,631 | 2/1993 | Kitajima | 134/164 |
| 5,318,356 | 6/1994 | Shelton | 312/223.1 |
| 5,333,628 | 8/1994 | Ogata et al. | 134/64 |
| 5,335,394 | 8/1994 | Cunninchan et al. | 134/135 |
| 5,456,275 | 10/1995 | Barish | 134/275 |

FOREIGN PATENT DOCUMENTS

| | | | |
|---|---|---|---|
| 2568111 | 7/1986 | France . | |
| 412981 | 3/1924 | Germany . | |
| 2429372 | 8/1976 | Germany . | |
| 06178876 | 6/1994 | Japan . | |
| 87679 | 10/1936 | Sweden | 134/116 |
| 164936 | 1/1934 | Switzerland | 134/111 |
| 0 337 132 | 11/1930 | United Kingdom . | |
| 1 206 791 | 9/1970 | United Kingdom . | |
| 1 206 792 | 9/1970 | United Kingdom . | |
| 2 129 732 | 5/1984 | United Kingdom . | |

OTHER PUBLICATIONS

A copy of a European Search Report dated Mar. 23, 1995.

*Primary Examiner*—Frankie L. Stinson
*Attorney, Agent, or Firm*—Fish & Richardson, P.C.

[57] ABSTRACT

The invention is directed to a cleaning device 5 for cleaning the shaving head 3 of a dry shaving apparatus 1, with a cradle structure 7 adapted to receive therein the shaving head 3, a cleaning fluid container 61 holding a cleaning fluid, as well as a device adapted to be driven by a motor 28 for feeding the cleaning fluid, wherein the cleaning fluid container 61 is separable from the cleaning device 5 and includes a filter means 24 integrally formed therewith.

20 Claims, 8 Drawing Sheets

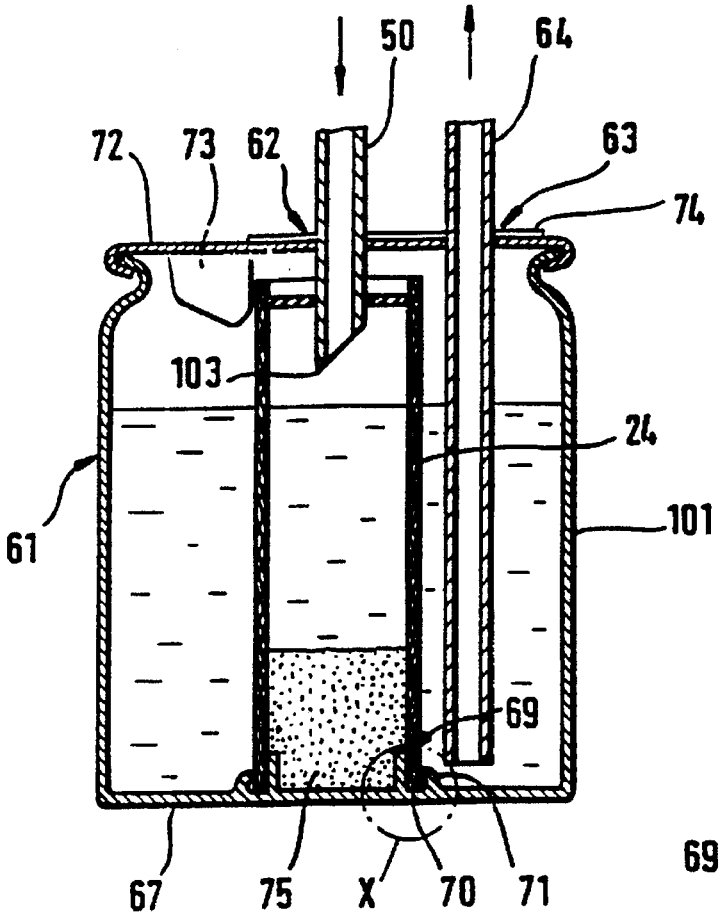
Fig. 7
Fig. 8
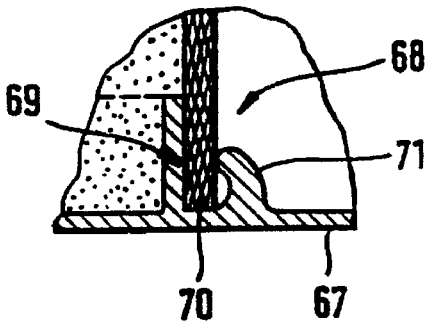
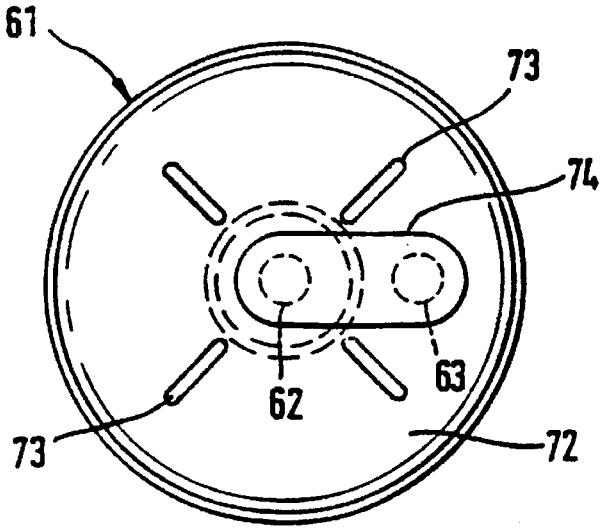
Fig. 9

CLEANING DEVICE FOR CLEANING THE SHAVING HEAD OF A DRY SHAVING APPARATUS

This invention relates to a cleaning device for cleaning the shaving head of a dry shaving apparatus, with a cradle structure adapted to receive therein the shaving head, a cleaning fluid container holding a cleaning fluid, as well as a device adapted to be driven by a motor for feeding the cleaning fluid.

From prior U.S. Pat. No. 3,172,416 a cleaning device for the cutter portion of a dry razor is known, comprising a cleaning casing in the upper area of which a seat is provided for receiving therein the cutter portion of an electric razor. According to a first embodiment, the individual components of the cutter portion are cleaned by a continuous stream of air directed to the cutter portion through an impeller means and filter elements. However, in cases where the cutter portion is severely contaminated carrying, for example, sebum, that is, grease particles, cleaning the cutter portion by means of an air stream is not accomplishable to the desired degree. The entire casing of the cleaning device through which air is blown is required to be sealed tight relative to atmosphere to prevent the swirled up hair dust from penetrating to the outside.

The same applies also to the cleaning device according to another embodiment (U.S. Pat. No. 3,172,416) in which the cutter portion is cleaned by a cleaning fluid directed for this purpose through fluid channels provided in the casing. For the full duration of the cleaning cycle, the cutter portion is seated in a cradle which is provided in the upper part of the casing and is at all times filled to capacity with cleaning fluid circulating therethrough. To accomplish this, a feed pump is provided in the casing. Because the cleaning fluid is not filtered during the cleaning operation, hair particles enter the cradle again and again, thus reaching the area of the cutter portion, so that this cleaning operation is equally not suited to accomplish satisfactory results, the less so since after deactivation of the pump device cleaning fluid with hair particles remain in the cradle, being thus prevented from being completely removed from the cutter portion. On termination of the cleaning cycle, it is necessary for the razor to be removed from its cradle to allow the cutter portion to drain and to be subsequently dried in the air. In this arrangement, the hair particles entrained with the cleaning fluid continue to adhere to the components of the cutter portion, so that ultimately a perfect cleaning action of the cutter portion is not achievable. The chamber provided in the lower part of the casing for collecting the cleaning fluid and the dirt particles must remain closed during recirculation of the cleaning fluid to prevent the dirt particle sediment accumulated therein from being agitated again. Yet it is not possible to prevent unfiltered cleaning fluid from being continuously directed against the cutter portion during circulation of the cleaning fluid.

Because the container receiving the cleaning fluid is fixedly integrated into the casing of the cleaning device, replacement of the cleaning fluid is a very complex procedure.

Accordingly, it is an object of the present invention to improve upon the cleaning device such as to allow ready replacement of the cleaning fluid container.

According to the present invention, this object is accomplished in that the cleaning fluid container is separable from the cleaning device and includes a filter means integrally formed therewith. Because the filter is made integrally with the cleaning fluid container, the container is readily removable together with the cleaning fluid after the cleaning fluid is used up or after the filter is largely clogged with dirt particles, such replacement merely involving the step of detaching the container from the feed pump. A new cleaning fluid container including a new filter can then be inserted in the wall mount receiving the dry shaving apparatus and be connected with the feed pump. In this manner, the cleaning device is fully operable again and can be utilized for cleaning the dry shaving apparatus for a prolonged period of time without requiring any intervention for maintenance.

Further, it is advantageous that the cleaning fluid container is comprised of two chambers, one chamber serving to hold the cleaning fluid, the other chamber being configured as the filter means.

According to a further feature of the cleaning fluid container of the present invention, an additional possibility is afforded in that the chambers are closed relative to the outside and are directly or indirectly connected to conduits of the feed pump and the cradle structure in a releasable manner. The coupling members for the releasable connection between the feed pump and the chambers may also be provided at the respective ends of the conduit between the feed pump and the cleaning fluid container or be formed integral with the conduit.

Advantageously, the cleaning fluid container or the chambers include ports or releasable connecting or coupling members which are adapted to be inserted in and/or clamped and sealed relative to mating members, at least one of the conduits has a tip at its end, and the cleaning fluid container and/or the ports are closable by means of a foil or a laminate through which the conduits are insertable.

It is a further advantage that a sealing member each is provided in the ports of the cleaning fluid container, which sealing members are adapted to be pierced by the respective ends of the conduits. Because the connection conduits may be provided with a tip or a sharp edge in the area of their respective ends, the ends of the connection conduits are readily insertable into the mating member which may be covered, for example, with a foil, a metal or plastic laminate. This completely dispenses with the need for assembly tools. By inserting the conduits into the associated inlet and outlet ports of the cleaning fluid container, a perfect seal is obtained between the conduits and the ports, thereby obviating the provision of additional sealing means.

In a further feature of the present invention it is advantageous that the cleaning fluid container has at its end locating means for aligning and laterally supporting the filter in the interior of the cleaning fluid container. The provision of locating means enables the filter to be accurately aligned for mounting in the cleaning fluid container, because the locating means force the filter into the proper position.

It is of particular importance to the present invention that the locating means are configured as rib means provided in the lid of the cleaning fluid container, and that the filter is fixedly and coaxially arranged within the casing of the cleaning fluid container between the coaxially arranged inlet port and the bottom of the casing. By virtue of the coaxial arrangement of the filter in the casing of the cleaning fluid container, it is ensured that the entire filter surface is well utilized.

In connection with the configuration and arrangement of the present invention, it is advantageous that the filter is comprised of a filter tube including a fabric or a mat material and extending along the full height of the casing.

It is a further advantage that the filter is coaxially secured in the casing at both its ends by the locating means, and that at one end the filter is centrally located and fixedly received in an annular groove provided at the bottom of the casing. Still further, it is advantageous that the annular groove is comprised of a wall or hem flange disposed at the bottom of the casing at right angles thereto, that the one end of the conduit connected to the outlet means of the feed pump is sealingly insertable into the inlet port coaxially arranged in the lid and the adjoining filter equally coaxially arranged, and that the second conduit provided in the cleaning fluid container and connected to the cradle structure or indirectly to the intake means of the feed pump is sealingly insertable into the outlet port of the lid. With the rectangular annular groove formed by means of wall portions, it is ensured that the filter is fixedly located in the casing of the cleaning fluid container in a simple and perfect fashion. In addition, this arrangement lends itself to mechanization readily.

To this effect, it is advantageous that the cleaning fluid container is adapted to be integrated and fixedly secured in a wall mount in which the shaving apparatus is insertable from the side and is mechanically and/or electrically interlockable by a switching means.

Still further it is advantageous that the shaving apparatus is receivable in a cradle structure that is open towards atmosphere and is supplied with cleaning fluid from the outwardly closed cleaning fluid container by means of the feed pump. This results in an open system for the cleaning device, enabling the shaving apparatus to be inserted laterally from outside into the cleaning device at any time, without the need to remove components or covers from the cleaning device. The cradle structure invariably contains only as much fluid as is necessary for cleaning the shaving head. The remaining cleaning fluid is held in the cleaning fluid container which is closed relative to atmosphere, thus preventing the volatile substances admixed to the cleaning fluid from vaporizing too rapidly.

It is another advantage that the shaving apparatus is first supplied with cleaning fluid from the cleaning fluid container integrated into the wall mount by means of the feed pump, and is subsequently dried by means of an impeller integrated into the cleaning device, with the feed pump and the impeller being adapted to be driven selectively in a clockwise or counterclockwise direction by means of a single motor using an overrunning device.

Another advantage is that the feed pump, the motor and/or the impeller and the cleaning fluid container are disposed in coaxial alignment with each other wholly or at least approximately and/or are mounted in the casing of the wall mount or the cleaning device.

Further advantages and details of the present invention will become apparent from the subsequent description and the accompanying drawings illustrating some preferred embodiments.

An embodiment of the present invention is shown in the Figures by way of example without being limited to this particular embodiment. In the drawings, FIG. 1 is a partial sectional view of a cleaning device in which a shaving apparatus is received;

FIG. 7 is a view of the cleaning fluid container configured as a cartridge, with an integrally formed filter means according to FIG. 6;

FIG. 8 is a partial view of the fastening structure of the lower part of the filter means in the casing of the cleaning fluid container;

FIG. 9 is a top plan view of the cleaning fluid container of FIG. 7 configured as a cartridge and including locating means;

Figure 1:
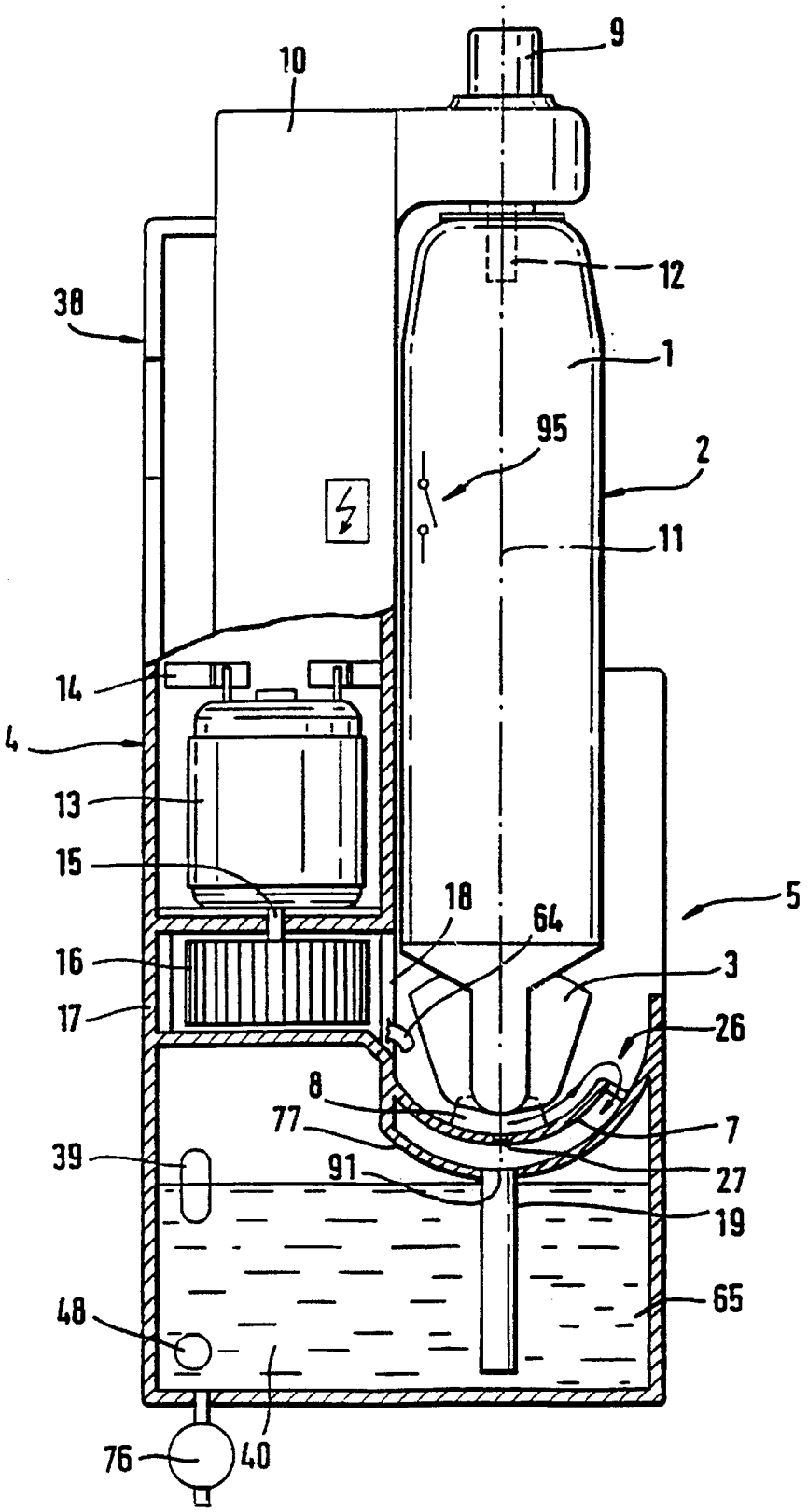
Figure 2:
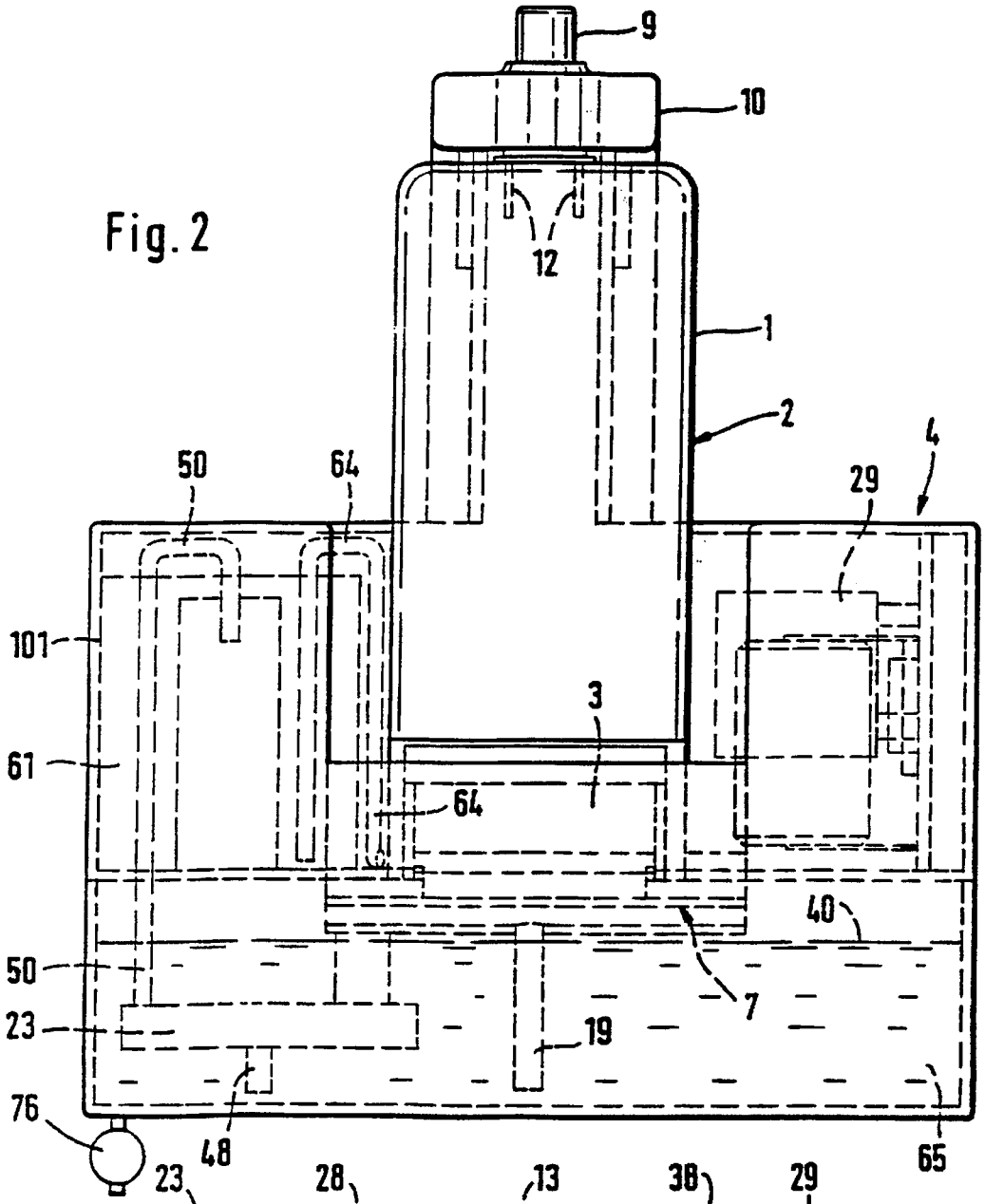
FIG. 2 is a front view of the cleaning device of FIG. 1.

Referring now to FIG. 1 of the drawings, there is shown an electric shaving apparatus or shaver 1 including a housing 2 and a shaving head 3 with an inner cutter, not shown in the drawings, the shaving head being pivotal relative to the housing 2 from the mid-position shown into opposite directions about a pivot axis.

The shaving apparatus 1 is received in a casing 4 of a cleaning device 5. The cleaning device 5 is comprised of a collecting reservoir 65 for receiving a fat-dissolving cleaning fluid 40 and of a cradle structure 7 which is configured as a cleaning dish, is slightly dished inwardly, thus conforming approximately to the outer contour of the shaving head 3 of the shaving apparatus 1, and holds only as much cleaning fluid as is necessary for the particular cleaning operation.

The cleaning device 5, in particular the wet portion thereof, that is, the cradle 7, is configured as a cleaning system open to atmosphere, whilst a cleaning fluid container 61, as subsequently described with reference to the embodiment of FIG. 7, is closed.

With its shaving head 3 in an inverted position, the shaving apparatus 1 is seated in the upwardly open cradle 7 configured as wet portion. During the cleaning cycle, cleaning fluid 40 is continuously flushed through the cradle 7. At a particular level of contamination, the cleaning fluid may be drained through a closable conduit 76, and fresh fluid may be substituted.

The cradle 7 includes an overflow device 26 which prevents the cleaning fluid in the cradle 7 from exceeding a defined level and ensures that only the shaving head 3 or the lower part of the shaving head is immersed in cleaning fluid. Further, the bottom of the cradle 7 includes an outlet port 27 allowing the cleaning fluid with hair particles to be completely drained into the collecting reservoir 65 after the cleaning cycle is completed. The capacity of the collecting reservoir 65 is substantially smaller compared with the capacity of the cleaning fluid container 61 of FIG. 7. However, the outlet port 27 is dimensioned such that the cradle 7, when supplied with cleaning fluid from a pump 23 described in the following, rather than being allowed to run empty, is at all times kept filled to the rim, with excess cleaning fluid being mainly discharged over the rim of the cradle 7 in the direction of the arrow over the overflow device 26, collecting in the reservoir 65 underneath. In this manner, a sufficient amount of cleaning fluid is at all times available for the cleaning cycle. Arranged below the cradle 7 is a collecting dish 77 conformed to the contour of the cradle 7, which dish is connected to the overflow device 26 or is a part of said overflow device 26. As becomes apparent from FIG. 1, the shaving head 3 rests in the cradle 7 by means of supporting means 8 serving to avoid damage to the shaving apparatus as it is placed down in the cradle 7 and to cushion the shaving apparatus during vibration.

Further, by means of a switching means 9 mounted in a bracket 10 the shaving apparatus 1 (FIG. 1) is mechanically and/or electrically interlocked. The bracket 10 is fixedly connected with a wall mount 38 enabling the complete cleaning device 5 with the shaving apparatus 1 to be mounted on a wall or, alternatively, to be kept in a stand for storage.

The switching means 9 which may be configured as a start button is arranged so as to be displaceable in the direction of a longitudinal center line 11 of the shaving apparatus 1 and is connected, by means of an electric control device 29, to timing elements serving to control the cleaning cycle.

The wall mount 38 and the bracket 10 open to the right when viewing FIG. 1 as well as the cradle 7 with the collecting reservoir 65 combine to form the cleaning device 5 which is a unit of U-shaped cross-section. The shaving apparatus 1 may continue to be stored in the wall mount 38 also upon completion of the cleaning cycle, because all cleaning fluid is drained from the wet portion or the cradle 7 after cleaning is terminated. The shaving apparatus 1 may also remain in the wall mount 38 for recharging. The cleaning device 5 is suitable for utilization with any type of electric shaving apparatus.

The switching means 9 has at its lower end two relatively spaced contact pins 12 for supplying current to the shaving apparatus 1, which contact pins, on depression of the switching means 9, cooperate with corresponding contact means of the shaving apparatus 1. In this manner, the shaving apparatus 1 can be set in operation when the switching means 9 is depressed and a power cord, not shown, of the cleaning device 5 is connected to an electrical outlet.

Adjacent to the shaving apparatus 1 in the casing 4 of the cleaning device 5 is an electric motor 13 having two electrical contact lugs 14 for connection to the electricity supply. Provided at the lower end of the electric motor 13 is a motor output shaft 15 on which an impeller or impeller wheel 16 is arranged serving in particular for drying the cleaned shaving head 3 of the shaving apparatus 1 following termination of the cleaning cycle of the shaving head 3 described in more detail in the following. The impeller 16 sits in an impeller casing 17 communicating through an opening 18 with the space above the cradle 7, and it directs a continuous stream of hot air heated by a heating means, not shown in the drawings, against the shaving head 3 to effect a drying action following the cleaning operation.

As mentioned in the foregoing, the bracket 10 combines with its vertically extending leg, a vertically extending leg of the wall mount 38 and the cradle 7 to form the U-shaped casing 4 when viewing the cleaning device 5 from the side, in which casing the shaving apparatus 1 is readily insertable from the side by imparting to it a lateral tilting motion, to be kept therein for storage.

According to FIG. 1, the cradle 7 extends into the collecting reservoir 65 which is filled with cleaning fluid to two thirds, maximum. Adjoining the underside of the cradle 7 is a connection means 19.

The connection means 19 is fixedly connected with an opening 91, the collecting dish 77 and the overflow device 26, and it is immersed in the cleaning fluid at all times. According to FIG. 1, the cradle 7 is arranged above the collecting reservoir 65 which is filled with some cleaning fluid 40.

The collecting reservoir 65 may be provided with a fluid level indicating means 39 enabling the fluid level to be monitored at all times. According to FIG. 1, the fluid level indicating means 39 may be configured as a small viewing window. In lieu of the viewing window, it is also possible to provide an electronic indicating means comprising suitable sensors indicating the fluid level or also the degree of contamination of the cleaning fluid 40. For example, when the fluid is contaminated to a degree which must not be exceeded, this condition may be indicated by the sensors, thus informing the operator of the need to drain the cleaning fluid 40 through the conduit 76 for replacement. Depending on the embodiment, the sensors may also be used for de-activating the electric control electrodes, thereby automatically interrupting the cleaning cycle and compelling the operator to replace the cleaning fluid.

As becomes apparent from FIG. 1, the connection means 19 is in communication with the collecting reservoir 65 to which an intake means 48 for the feed pump 23 is connected, the pump delivering the cleaning fluid through a conduit 50 to a filter means 24 according to FIG. 7. Further details will be explained with reference to FIGS. 7 and 8.

To perform the cleaning cycle, the shaving apparatus 1 to be cleaned is introduced into the cleaning device 5 from the side and subsequently locked in place by the switching means 9 which, initially occupying its upper position, is for this purpose displaced downwards into a second position until the two contact lugs engage the contact pins 12 provided in the shaving apparatus 1. The shaving apparatus 1 is thereby interlocked electrically and mechanically, allowing the operator to withdraw the shaving apparatus 1 not until after the cleaning and the subsequent drying cycle have been completed, canceling the interlock.

Figure 4:
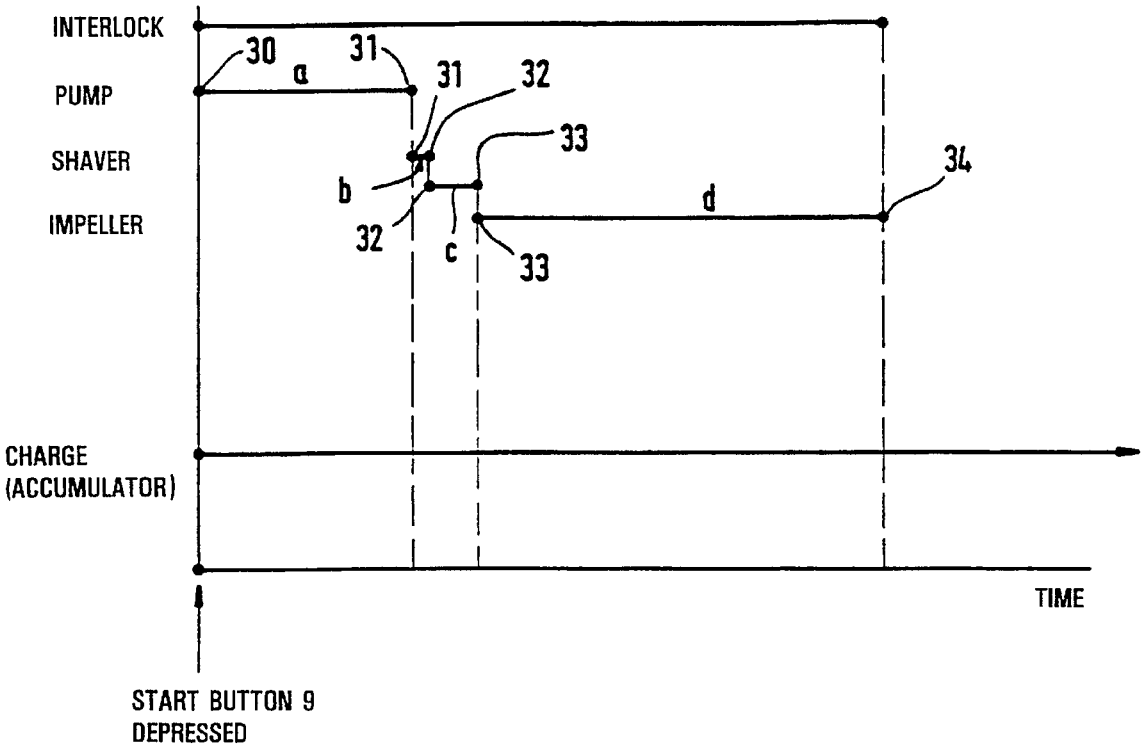
FIG. 4 is a schematic diagram depicting the individual cleaning stages as a function of time.

Operation of the switching means 9 causes the feed pump 23 to be driven which then delivers cleaning fluid to the cradle 7 and to the shaving head 3 for a predetermined period of time, the fluid dislodging all of the hair dust 75 in the shaving head 3 (see segment 30 to 31 in FIG. 4).

The cleaning fluid with the hair dust 75 is then passed through the outlet port 27 to the cradle 7 and over the overflow device 26 to the collecting reservoir 65, and onwards directly to the feed pump 23 through the intake means 48 and back to the filter 24. This has the advantage that the cleaning fluid with the complete hair dust 75 from the shaving apparatus 1 is delivered in concentrated form to the filter 24 in which the cleaning fluid is completely cleaned.

Figure 3:
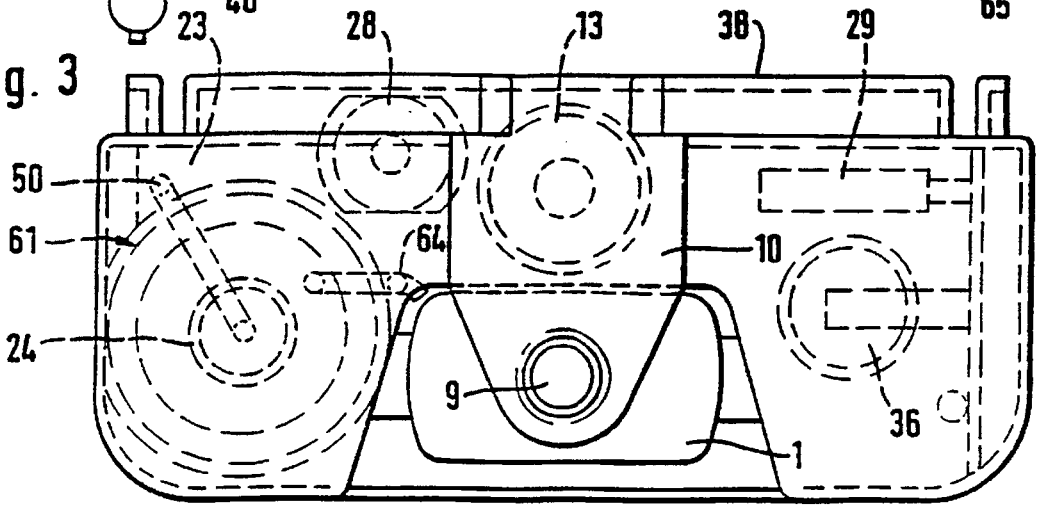
FIG. 3 is a top plan view of the cleaning device of FIG. 2.

FIG. 3 shows schematically in top plan view the arrangement of the essential parts of the cleaning device 5 including, for example, the collecting reservoir 65 and a motor 28 which is turned on by the switching means 9. When viewing this Figure, there is shown to the right of the bracket 10 supporting the shaving apparatus 1 the electric control device 29 including timing elements, not shown, for controlling the individual stages of the cleaning cycle. Further arranged in the area of the bracket 10 is the motor 28 adapted to drive directly the impeller 16 which is operatively associated with a heating means for heating the air used for drying the shaving apparatus 1.

To be able to step the line voltage down to the requisite operating voltage, the cleaning device 5 is provided with a transformer 36.

FIG. 4 is a schematic diagram depicting the individual stages of the cleaning cycle as a function of time. The individual segments between points 30 to 34 show the individual cyclic stages of the cleaning operation.

When, as initially mentioned, the switching means 9 is actuated at point 30 of FIG. 4 by downward displacement (control button depressed), this has the concurrent effect of causing oscillation of the inner cutters, not shown, of the shaving apparatus 1, thereby producing in the shaving head 3 a flow with partially occurring cavitation which dislodges hair dust 75 and also grease particles from the inner cutters of the shaving head completely. Owing to the fluid being agitated, the fluid level in the cradle 7 is temporarily increased, while at the same time splashes are produced in the area of the shaving head 3 performing a thorough cleaning function on the shaving head 3 as well as the inner cutters although the level of the cleaning fluid reaches only part of the shaving head 3. Depending on the type of cleaning fluid utilized and the degree of contamination of the shaving head, the cleaning action lasts between 3 and 60 seconds (see segment a between points 30 and 31). When the shaving apparatus 1 is not cleaned at regular intervals, the cleaning cycle (segment a between points 30 and 31) is extended correspondingly. To accomplish this, the cleaning device may be provided with a two-step switch not shown in the drawings, the first step being intended for a regular cleaning cycle and the second step for an intensive cleaning cycle.

On completion of the cleaning cycle, the feed pump 23 is automatically turned off at point 31 (end of the cleaning cycle) of FIG. 4. This then enables the cleaning fluid to be drained completely through the outlet port 27, thus causing the wet portion or the cradle 7 to be evacuated. The level in the collecting reservoir 65 rises a small amount. The outlet port 27 may also be closable by a valve, not shown in the drawings, which opens automatically when point 31 is reached. After about 30 seconds, the cradle 7 is completely emptied (see segment b between points 31 and 32, draining the cradle 7).

After the cradle 7 is drained at point 32, the shaving head 3 continues oscillating for some time, shaking off any cleaning fluid that may still adhere to the shaving head 3. After the set time has elapsed, the shaving apparatus 1 is turned off, and the inner cutter of the shaving head 3 stops moving at point 33 (end of the vibratory cycle). The turn-on and turn-off operations are accomplished by means of an electromagnetic reed switch 95 shown schematically which, according to FIG. 1, is accommodated in the housing 2 of the shaving apparatus 1. When the reed switch 95 is opened automatically on completion of the vibratory cycle, operation of the shaving apparatus 1 is also discontinued, initiating at point 33 the drying cycle described in the following (segment d).

Being automatically inserted in the circuit at point 33, the impeller 16 is turned on with or without heating means and driven by the electric motor 13, thus delivering dry air to the shaving head 3 for a predetermined period of, for example, 15 seconds (see segment d between points 33 and 34). Then the interlock of the shaving apparatus 1 is deactivated at the control button 9.

Figure 6:
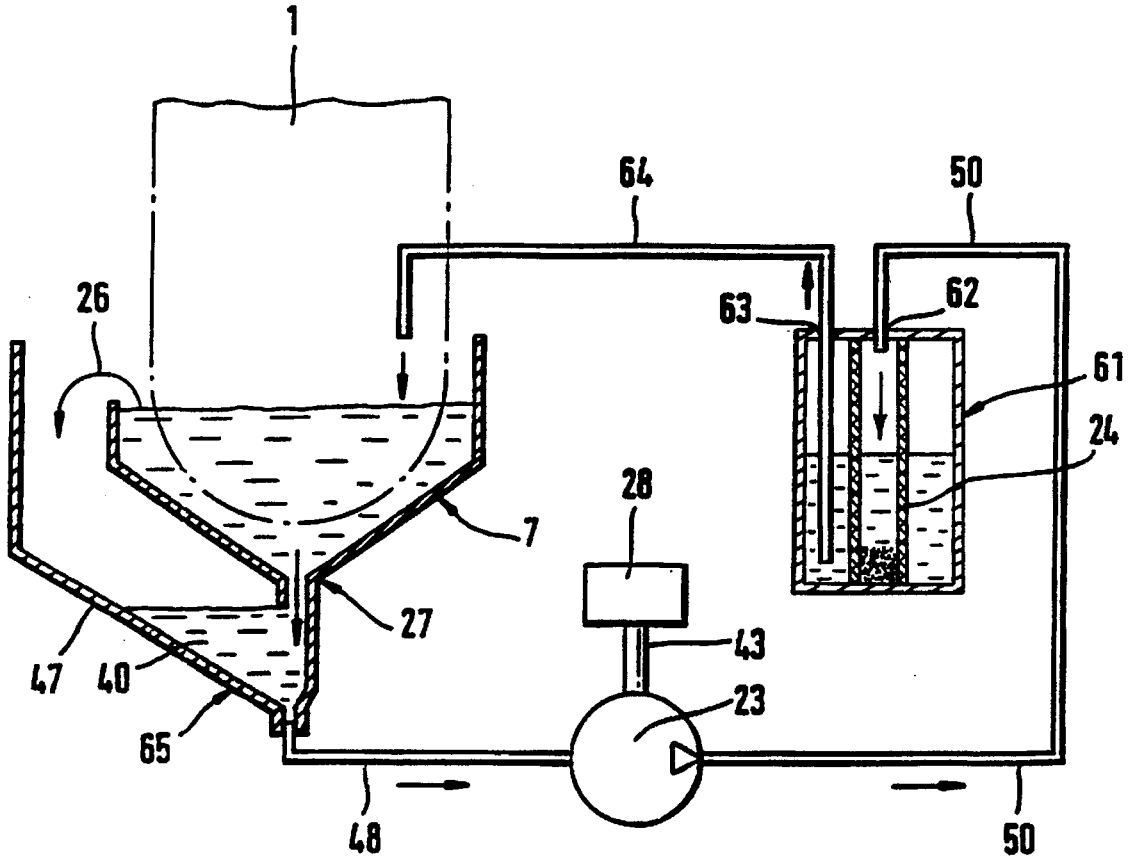
FIG. 6 is a schematic representation of the fluid circuit of the cleaning device, in particular between the cradle structure, the filter means and the cleaning fluid container configured as a cartridge.

FIG. 6 shows schematically the fluid circuit of the cleaning fluid of the cleaning device 5 which incorporates the cradle 7 in which the shaving apparatus 1 is inserted in an inverted position so that the shaving head 3 is at least partially immersed in the cleaning fluid.

The cleaning device 5 further incorporates (FIG. 6) the feed pump 23 and the motor 28 connected to a supply of electricity through electrical lines and activatable by the switching means 9. The feed pump 23 is driven by the motor 28 adapted to bear against supporting means in the casing 4 of the cleaning device 5.

A drive shaft 43 projecting from the motor 28 drives the feed pump 23 provided in a pump casing.

As becomes further apparent from FIG. 6, the collecting reservoir 65 for receiving the cleaning fluid 40 is smaller than in the first embodiment of FIG. 1. The collecting reservoir 65 has a bottom 47 arranged at an inclination, for example, at an angle of between 20° and 40° to prevent hair particles from collecting at the bottom 47. An intake means 48 of the feed pump 23 is attached to the lower area of the bottom 47, so that the cleaning fluid discharged over the overflow device 26 is conveyed, through the collecting reservoir 65, the intake means 48 of the feed pump 23 as well as a conduit 50, directly to the filter 24 illustrated in greater detail in FIGS. 7, 8 and 9. The hair dust 65 collecting in the reservoir 65 is agitated in the cleaning fluid such that it is fed to the filter 24 and retained thereby, rather than being allowed to settle at the bottom 47 of the collecting reservoir 65. The filtered cleaning fluid is then circulated back to the cradle 7 through a conduit 64.

A cleaning fluid container 61 is configured as a cartridge (FIGS. 7 to 9) and includes an outlet port 63 communicating with the cradle 7 through the conduit 64. In this manner, the cleaning circuit is closed. The container 61 inlet and outlet ports 62, 63 shown in FIG. 7 may also be provided at a bottom 67 of the cleaning fluid container 61, enabling the cleaning fluid container 61 to be connected to suitable conduits from above. It thereby achieved that a permanent flow of cleaning fluid is delivered from the cleaning fluid container 61 to the intake means of the pump 23, causing the pump to draw only cleaning fluid, rather than air, when put into operation.

According to this embodiment (FIG. 6), the switching means 9 activates the feed pump 23 configured as a vane-type pump drawing air at the beginning of the cleaning cycle and forcing this air through the conduit 50 into the cleaning fluid container 61 so that the cleaning fluid flows from the cleaning fluid container 61 through the outlet port 63 and the conduit 64 to the drained cradle 7, refilling it until the cleaning fluid is discharged to the collecting reservoir 65 over the overflow device 26. Part of the fluid is continuously drained through the outlet port 27. Considering, however, that the feed pump 23 delivers more fluid to the cradle 7 than can be drained through the outlet port 27, it is ensured that during the cleaning cycle the cradle 7 remains filled with fluid to the level of the overflow device 26.

The cleaning fluid container 61 or cartridge shown in FIGS. 7 to 9 is comprised of a cylindrical casing 101 having a bottom 67 and a lid 72 in which the inlet port 62 and the outlet port 63 as well as the filter 24 are provided.

The lid 72 is sealed relative to the upper rim of the cleaning fluid container 61 by hemming such as to prevent it from being pulled off the casing 101. The conduit 50 arriving from the pump 23 is connected to the inlet port 62, while the conduit 64 leading to the cradle 7 is connected to the outlet port 63. Quick-release coupling members, not shown in the drawings, may be provided in the area of the inlet and outlet ports 62, 63 to allow ready replacement of the cleaning fluid container 61 when it is necessary to renew the cleaning fluid or when the filter 24 provided in the cleaning fluid container 61 has become clogged.

The degree of contamination or the hair dust 75 retained in the filter 24 may be determined by means of an indicating device not shown in the drawings. The indicating device may include a pressure sensor and a telltale light indicating the degree of contamination or the pressure status. When the filter 24 is no longer usable, the cleaning fluid container 61 is detached from the conduits 50, 64, and a new one is substituted.

In the embodiment of FIGS. 7 to 9, the filter means 24 is configured as a cylindrical paper filter arranged coaxially in the casing 101.

According to FIG. 8, the filter 24 is forced with a lower end 70 thereof into engagement with an annular groove 68 provided at the bottom 67 of the casing 101 coaxially therewith. The annular groove 68 is comprised of two relatively spaced parallel annular walls or hem flanges 69, 71 projecting from the bottom 67 so that the lower end 70 of the filter 24 is clampingly engaged within the annular groove 68. The filter 24 forms a first chamber receiving the hair dust, while the remaining part of the casing forms a second chamber for holding filtered cleaning fluid.

As becomes apparent from FIG. 9, the upper lid 72 of the casing 101 of the cleaning fluid container 61 includes four relatively spaced locating means 73 arranged in cross shape and serving to locate the filter within the cleaning fluid container 61.

The lid 72 (FIGS. 7, 9) further includes a foil 74 which is pierced by the conduits 50, 64 as the cleaning fluid container 61 is inserted in the casing 4, thereby establishing the coupling engagement with the inlet and outlet ports 62 and 63, respectively. Conveniently, the two conduits 50, 64 may be provided with a sharp edge or tip 103 at their respective ends to facilitate piercing of a foil sealing the ports 62, 63. It is also possible to seal the ports 62, 63 by means of a pull-off strap under which sealing members capable of being pierced may be provided into which the conduits 50, 64 are inserted.

Figure 11:
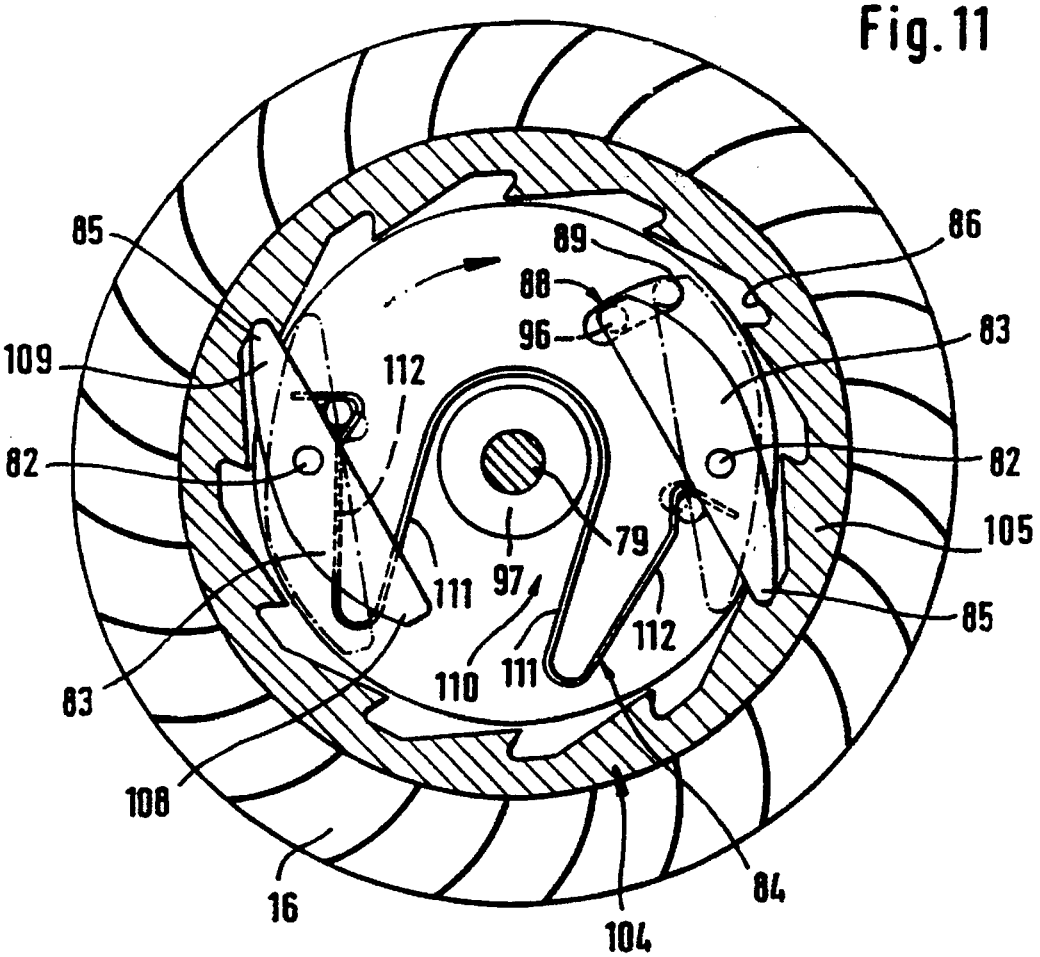
FIG. 11 is a sectional view taken along the line A—A of FIG. 10.
Figure 5:
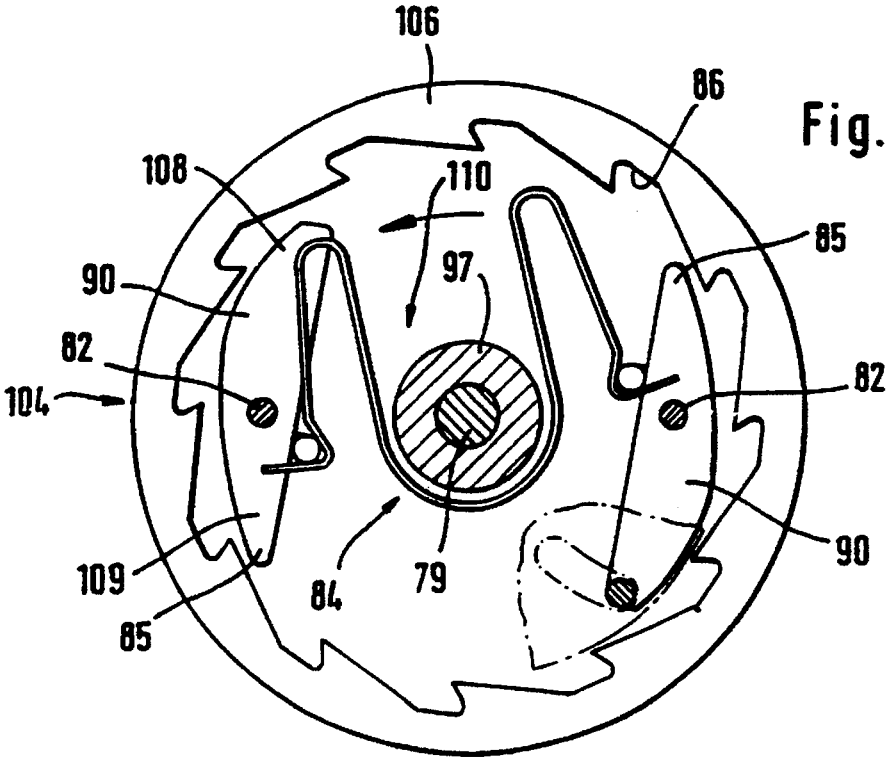
FIG. 5 is a sectional view taken along the line B—B of FIG. 10.
Figure 10:
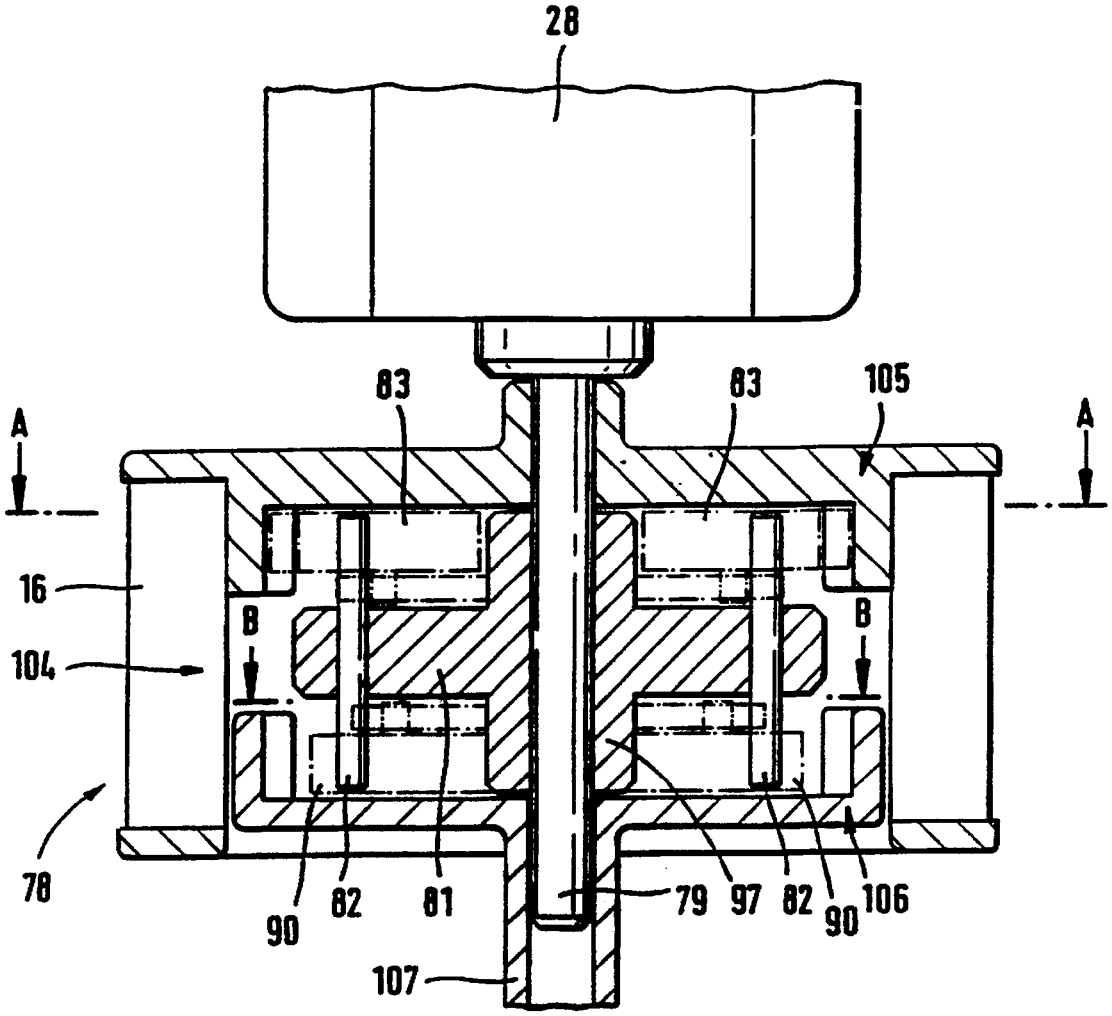
FIG. 10 is a sectional view of a drive mechanism for the impeller and the pump, including an overrunning device.

FIGS. 5, 10 and 11 illustrate a mechanism 78 for driving the impeller 16 and the feed pump 23. Since it is not desirable to drive the feed pump 23 and the impeller 16 at the same time, they may be driven selectively by the single motor 28. The drive mechanism 78 which also includes the motor 28 is provided with a device reversing the direction of rotation which includes one (FIG. 12) or, according to FIGS. 5 and 11, two over-running devices 104, one driving the impeller 16 in a clockwise direction, the other driving the feed pump 23 in a direction opposite thereto.

Figure 12:
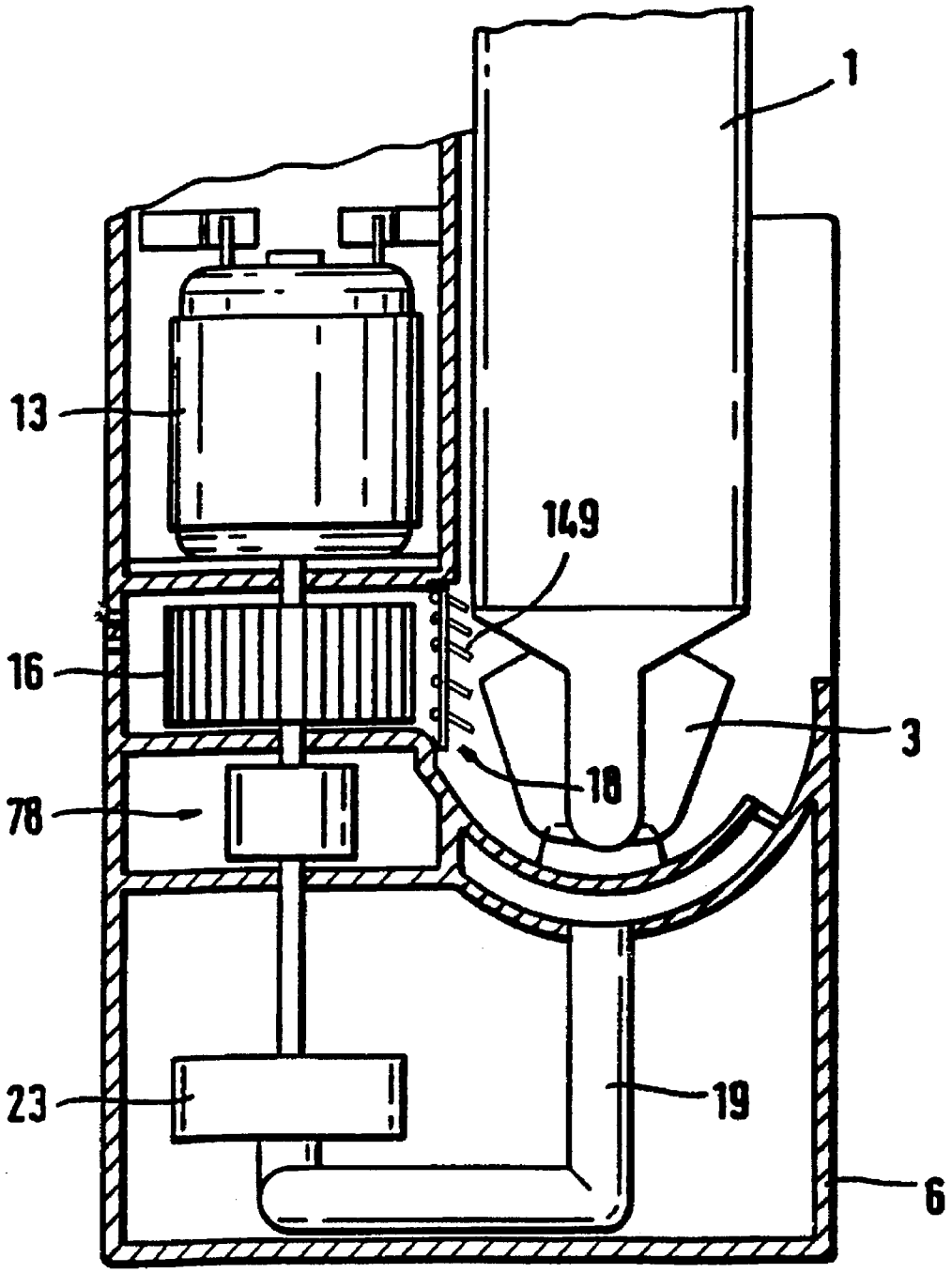
FIG. 12 is a view of a further embodiment of a drive mechanism for the pump and the drying device.

The device reversing the direction of rotation, together with the upper and the lower overrunning device 104, is seated on a motor output shaft 79 of the motor 28 on which also the impeller 16 is arranged. The overrunning device 104 may be provided with a clamp-type locking mechanism including for this purpose a one-way coupling with self-locking frictional engagement. Further, clamping rollers or clamping plates may be provided as coupling means. In the embodiment of FIGS. 11 and 12, the overrunning devices 104 are comprised of internal gear rings 105, 106 having an upper and a lower tooth flank 86. The two internal gear rings 105, 106 are mounted on the motor output shaft 79 so as to rotate freely. The motor output shaft 79 drives a driving flange 81 which includes two diametrically opposite pawl axles 82 receiving each an upper and a lower crescent-shaped pawl 83, 90. The pawls 83, 90 include each two lever arms 108, 109 of different length (FIG. 11), with the longer lever arm 108 being guided in a slotted hole 88 by means of a pin 96, while the other lever arm 109 bears against a spring 84. FIGS. 5 and 11 show each one slotted hole 88.

The pawl 83 (FIG. 11) is pivotal on the pawl axle 82 in the direction of the inner periphery of the impeller 16 between a position shown in solid lines and a position shown in broken lines by means of the spring 84 bent twice in V-shape. The spring 84 includes a U-shaped member 110 by means of which it is seated on a hub 97 of the driving flange 81. The U-shaped member 110 is formed of two legs 111 which, each in combination with a further adjoining leg 112, form a double V.

In the position illustrated in FIG. 11, the two pawls 83 have an outer end 85 thereof in engagement with the tooth flanks 86 of the gear ring 105 connected to the impeller 16, thus establishing a driving relationship, in a clockwise direction, of the motor 28 to the impeller 16. The legs 112 of the spring 84 urge, through an abutment means, the end 85 of the lever arm 108 into engagement with the tooth flank 86.

When the motor output shaft 79 is driven in a counterclockwise direction, the pawls 83 are urged outwardly by the tooth flanks 86 and, at a minimum rotational frequency, are pivoted on the pawl axle 82 outwardly in a clockwise direction in opposition to the action of the spring 84 owing to their eccentric arrangement on the pawl axle 82, until they engage a stop 89 of the slotted hole 88. This is accomplished in that the weight component of the lever arm 108 is greater than that of the other lever arm 109 of the pawl 83 relative to the pawl axle 82. As a result, the impeller 16 is disengaged from the motor output shaft 79. This position is maintained until the centrifugal moment has diminished due to a reduced rotational frequency to a level at which the spring moment prevails and the pawls 83 return to their engaged positions according to FIG. 11 (see the position of pawl 83 shown in solid lines).

By driving the motor output shaft 79 in a manner similar to the mode of operation of FIG. 11, yet in a counterclockwise direction, two further pawls 90 arranged below the driving flange 81 are then equally pivoted on the pawl axles 82 by means of the spring 84, their ends 85 engaging the tooth flanks 86, so that the pump 23 is operated by the same motor 28 and by a hollow shaft 107 disposed on the motor output shaft 79, whereas the two upper pawls 83 are maintained disengaged. At the beginning of the cleaning operation, only the pump 23 is driven according to FIG. 11, and the impeller 16 is released according to FIG. 5.

The two lower pawls 90 do not leave their engaged positions, thereby canceling the driving relationship of the motor 18 to the feed pump 23, until the direction of rotation of the motor 28 is changed. Because the outer ends of the pawls 83, 90 do not slip over the tooth flanks 86, noise and wear are prevented from occurring with the pawls 83, 90 running freely.

Owing to the advantageous driving relationship for selectively driving the feed pump 23 and the impeller 16, the requirement of having to provide a second drive motor for driving feed pump 23 and impeller 16 separately is obviated, so that cost savings may be realized.

The motor 28 and the impeller 16 as well as the pump 23 not shown in FIGS. 5, 10 and 11 and, if desired, the cleaning fluid container 61 may be arranged vertically on a common axis, which enables the number of gear parts between the motor 28, the pump 23 and the impeller 16 to be reduced to a minimum and, in consequence, allows the casing 4 of the cleaning device 5 to be built to smaller dimensions (see FIG. 12).

A further embodiment of a drive mechanism for the pump 23 and the drying device incorporating the impeller 16 is illustrated in FIG. 12.

In this embodiment, an overrunning arrangement 78 similar to the overrunning device of FIG. 11 comprises only two pawls 83 or some other coupling means. The coupling means establish a driving relationship between the motor 13 and the pump 23 or prevent the pump 23 from following the motor 13 in rotation when its direction of rotation is reversed. It will be understood that an overrunning arrangement configured in a manner different from the one shown in FIG. 11 may also be utilized.

When the overrunning arrangement establishes a driving connection between the motor 13—rotating, for example, in a counterclockwise direction—and the pump 23, the pump 23 is driven jointly with the impeller 16, and the pump 23 is in a position to direct cleaning fluid to the cradle 7.

The impeller 16 is prevented from drawing air from the cradle 7 because a louvered shutter 149 provided in the opening 18 remains closed as a result of the vacuum produced by the impeller 16.

Because of the very simple configuration of the overrunning arrangement, the electric motor 13 invariably drives the impeller 16 in either direction, so that with the motor 13 driven in a clockwise direction the air stream produced by the impeller 16 opens the louvered shutter 149 provided in the opening 18, feeding air to the shaving head 3 for drying.

When the motor 13 is driven in a counterclockwise direction, the stream of air produced by the then equally driven impeller 16 generates a vacuum in the area of the opening 18, causing the louvered shutter 149 to be closed again or to remain closed.

I claim:

1. A cleaning device for cleaning a shaving head of a dry shaving apparatus, said cleaning device comprising:

a cradle structure adapted to receive therein the shaving head;

a cleaning fluid container separate from the cradle structure for holding a cleaning fluid;

a filter; and a fluid feed mechanism which feeds the cleaning fluid after it passes through the filter to the cradle structure during cleaning, said container and filter being separable from the cradle structure as a unit.

2. A cleaning device as claimed in claim 1, wherein the cleaning fluid container is comprised of two chambers, one chamber serving to hold the cleaning fluid, the other chamber being configured as the filter.

3. A cleaning device as claimed in claim 2, further comprising a first conduit which releasably couples the chamber holding the cleaning fluid to the cradle structure and a second conduit which releasably couples the chamber configured as the filter to the fluid feed mechanism, and wherein the chambers are closed relative to the outside of the cleaning fluid container with fluid communication to and from the container provided through the conduits.

4. A cleaning device as claimed in claim 3 wherein at least one of the conduits has a tip at its end, and the cleaning fluid container ports are closed with a foil or a laminate through which the conduits are inserted.

5. A cleaning device as claimed in claim 3, wherein the cleaning fluid container comprises a lid having an inlet port coaxially arranged in the lid and an outlet port and one end of the second conduit, coupled to the outlet means of the fluid feed mechanism is sealingly insertable into the inlet port and the filter, and the second conduit provided in the cleaning fluid container and coupled to the cradle structure (7) is sealingly insertable into the outlet port of the lid.

6. A cleaning device as claimed in claim 1, wherein the cleaning fluid container includes ports through which cleaning fluid passes in and out of the cleaning fluid container.

7. A cleaning device as claimed in claim 6, wherein each of said ports includes a sealing member, said sealing members being adapted to be pierced by the respective ends of the conduits.

8. A cleaning device as claimed in claim 1, wherein the cleaning fluid container has at its end, a locating member which aligns and laterally supports the filter in the interior of the cleaning fluid container.

9. A cleaning device as claimed in claim 8, wherein the cleaning fluid container comprises a lid and the locating members are configured as rib members disposed on the lid.

10. A cleaning device as claimed in claim 8, wherein the cleaning fluid container comprises a casing and the filter is fixedly and coaxially arranged within the casing between a coaxially arranged inlet port and a bottom portion of the casing.

11. A cleaning device as claimed in claim 8, wherein the filter comprises a filter tube including a mat material extending along the full height of the casing.

12. A cleaning device as claimed in claim 8, wherein the cleaning fluid container comprises a casing and the filter is coaxially secured in the casing at both its ends by the locating members.

13. A cleaning device as claimed in claim 8, wherein the cleaning fluid container comprises a casing having an annular groove disposed at the bottom of the casing, the filter being centrally located and fixedly received at one of its ends in the annular groove.

14. A cleaning device as claimed in claim 13, wherein the annular groove is comprised of a pair of walls disposed at the bottom of the casing at right angles thereto.

15. A cleaning device as claimed in claim 1, further comprising a wall mount in which the shaving apparatus is insertable from the side and by a switch connected to the wall mount to interlock said shaving apparatus to the wall mount, said cleaning fluid container adapted to be integrated and fixedly secured within the wall mount.

16. A cleaning device as claimed in claim 15 wherein said switch mechanically interlocks said shaving apparatus to the wall mount.

17. A cleaning device as claimed in claim 15 wherein said switch electrically interlocks said shaving apparatus to the wall mount.

18. A cleaning device as claimed in claim 1, wherein the cradle structure is open towards atmosphere and is supplied with cleaning fluid from the cleaning fluid container by means of the fluid feed mechanism.

19. A cleaning device as claimed in claim 1, further comprising a motor which drives said fluid feed mechanism and an impeller which dries the shaving head after cleaning, wherein, with the fluid feed mechanism and the impeller being adapted to be driven selectively in at least one of a clockwise and counterclockwise direction using said motor.

20. A cleaning device as claimed in claim 19, wherein the feed pump, the motor, the impeller, and the cleaning fluid container are substantially disposed in coaxial alignment with each other in the cleaning device.

* * * * *